US009030403B2

(12) United States Patent
Akimoto et al.

(10) Patent No.: US 9,030,403 B2
(45) Date of Patent: May 12, 2015

(54) PIXEL CIRCUITS AND METHODS FOR DISPLAYING AN IMAGE ON A DISPLAY DEVICE

(71) Applicant: Pixtronix, Inc., San Diego, CA (US)

(72) Inventors: Hajime Akimoto, Kokubunji (JP); Toshio Miyazawa, Chiba (JP)

(73) Assignee: Pixtronix, Inc., San Diego, CA (US)

( * ) Notice: Subject to any disclaimer, the term of this patent is extended or adjusted under 35 U.S.C. 154(b) by 230 days.

(21) Appl. No.: 13/650,155

(22) Filed: Oct. 12, 2012

(65) Prior Publication Data

US 2013/0093741 A1 Apr. 18, 2013

(30) Foreign Application Priority Data

Oct. 14, 2011 (JP) ..... 2011-226844

(51) Int. Cl.
*G09G 5/00* (2006.01)

(52) U.S. Cl.
CPC ..... *G09G 5/00* (2013.01)

(58) Field of Classification Search
USPC ..... 345/31, 85, 108–109, 204; 359/227, 359/230, 236, 578, 196.1–197.1, FOR. 100; 348/56, 296, 367, E5.037
See application file for complete search history.

(56) References Cited

U.S. PATENT DOCUMENTS

| | | | | |
|---|---|---|---|---|
| 7,839,356 | B2 * | 11/2010 | Hagood et al. | 345/55 |
| 2006/0250325 | A1 * | 11/2006 | Hagood et al. | 345/55 |
| 2007/0002156 | A1 * | 1/2007 | Hagood et al. | 348/296 |
| 2008/0129681 | A1 * | 6/2008 | Hagood et al. | 345/109 |
| 2008/0174532 | A1 | 7/2008 | Lewis | |
| 2012/0154455 | A1 * | 6/2012 | Steyn et al. | 345/690 |
| 2012/0306562 | A1 * | 12/2012 | Miyamoto et al. | 327/434 |
| 2012/0306842 | A1 * | 12/2012 | Miyazawa et al. | 345/212 |

* cited by examiner

*Primary Examiner* — Lun-Yi Lao
*Assistant Examiner* — Elliott Deaderick
(74) *Attorney, Agent, or Firm* — Edward A. Gordon; Foley & Lardner LLP

(57) ABSTRACT

A pixel circuit includes a first control electrode and a second control electrode between which a mechanical shutter is put, and a first control voltage application circuit for inputting a first control voltage to the first control electrode according to an image signal. The first control voltage application circuit includes an input transistor, a retaining capacitor and a first transistor. One of current terminals of the input transistor is connected to a signal line. A gate of the input transistor is connected to a scanning line. One terminal of the retaining capacitor is input with a capacitor control signal and the other terminal is connected to the input transistor. The first transistor has a gate connected to the retaining capacitor and two current terminals, one of which is connected to a first control electrode and the other of which is input with a first control signal.

7 Claims, 14 Drawing Sheets

PIXEL CIRCUITS AND METHODS FOR DISPLAYING AN IMAGE ON A DISPLAY DEVICE

CROSS REFERENCE TO RELATED APPLICATION

This application is based upon and claims the benefit of priority from the prior Japanese Patent Application No. 2011-226844, filed on 14 Oct. 2011, the entire contents of which are incorporated herein by reference.

FIELD

The present invention is related to a display device and a method of driving the display device. In particular, the present invention is related to an effective technology which is applied to a pixel circuit of an image display device which electrically controls the position of a mechanical shutter to display an image.

BACKGROUND

An image display device (below referred to as a mechanical shutter type image display device) arranged with a pixel circuit which electrically controls the position of a mechanical shutter to display an image is used as described in US Patent 2008/0174532.

FIG. 14 is a circuit diagram which shows a pixel circuit of a conventional mechanical shutter type image display device.

A conventional mechanical shutter type image display device is explained below with reference to FIG. 14.

A signal line 206 is connected to each pixel 213. Specifically, the signal line 206 and a signal retaining capacitor 204 of each pixel 213 are connected via a scanning switch 205.

The signal retaining capacitor 204 is further connected to a gate of an nMOS transistor 203 for programming a shutter negative voltage. The drain of the nMOS transistor 203 for programming a shutter negative voltage is connected to the drain of a pMOS transistor 202 for programming a shutter positive voltage, via a cascode nMOS transistor 216 and a cascode pMOS transistor 215.

Each pixel 213 includes a dual actuator shutter assembly 201 connected to a shutter voltage line 211. One of two control electrodes of the dual actuator assembly 201 is connected to a drain of the nMOS transistor 203 for programming a shutter negative voltage via the cascode nMOS transistor 216. The other control electrode is connected to a control electrode voltage line 209.

The other end of the signal retaining capacitor 204 is connected to the shutter voltage line 211. A source of the nMOS transistor 203 for programming a shutter negative voltage is connected to an nMOS transistor source voltage line 212 for programming a shutter negative voltage. The gate and drain of the pMOS transistor 202 for programming a shutter positive voltage are connected to a pMOS gate voltage line 207 for programming a shutter positive voltage and a positive voltage line 208 respectively. The gate of the cascode nMOS transistor 216 and the gate of the cascode pMOS transistor 215 are connected to a cascode gate voltage line 217. The gate of the scanning switch 20-5 is connected to a scanning line 210.

The dual actuator shutter assembly 201 is arranged facing an aperture punctured into a light blocking surface. A plurality of pixels 213 having structures as described above are arranged in a matrix shape in the image display device.

Next, the operation of an image display device applied with a conventional mechanical shutter is explained.

An image signal voltage applied to a signal line 206 is stored in the signal retaining capacitor 204 of each pixel 213 via the scanning switch 205 of each pixel 213 by scanning the scanning lines 210 in sequence.

Next, after programming an image signal voltage to the signal retaining capacitor 204 of all the pixels 213 is completed, an image signal is written to one of the two control electrodes of the dual actuator shutter assembly 201 based on the written image signal voltage in each pixel 213. That is, first, in all of the pixels 213, by applying a low voltage for a certain period of time to the pMOS gate voltage line 207 for programming a shutter positive voltage, the pMOS transistor 202 for programming a shutter positive voltage is switched to an ON state for only this period of time and a certain voltage applied to the positive voltage line 208 is precharged to one of the two control electrodes of the dual actuator shutter assembly 201.

Next, a low voltage is applied for a certain period of time to the nMOS source voltage line 212 for programming a shutter negative voltage. Then, the nMOS transistor 203 for programming a shutter negative voltage is switched to an ON state for this period of time only in the pixel 213 in which a high voltage is written to the signal retaining capacitor 204 as an image signal voltage and thereby a voltage written to one of the two control electrodes of the dual actuator shutter assembly 201 is converted to a certain low voltage applied to the nMOS source voltage line 212 for programming a shutter negative voltage.

In addition, in a pixel in which a low voltage is written to the signal retaining capacitor 204 as an image signal voltage, because the nMOS transistor 203 for programming a shutter negative voltage is kept in an OFF state during this period of time, the voltage of one of the two control electrodes of the dual actuator shutter assembly 201 is maintained at the already precharged certain positive voltage.

In this way, although amplification programming of an image signal is performed to one of two control electrodes of the dual actuator shutter assembly 201, at the same time the dual actuator shutter assembly 201 is electrostatically operated by controlling the voltage applied to the control electrode voltage line 209. Because the dual actuator shutter assembly 201 which operates in the way controls the amount of light which passes through the aperture by opening and closing the aperture arranged on a light blocking surface, the image display device can display an image corresponding to a written image signal voltage on an a pixel matrix.

Furthermore, in the operation described above, the cascode nMOS transistor 216 and the cascode pMOS transistor 215 are arranged in order to prevent a high drain voltage having a short lifespan from being applied to the pMOS transistor 202 for programming a shutter positive voltage and the nMOS transistor 203 for programming a shutter negative voltage.

In the pixel circuit of a conventional mechanical shutter type image display device, it was necessary to arrange the cascode nMOS transistor 216 and cascode pMOS transistor 215 in order to prevent deterioration caused by applying a high voltage to the drain of the pMOS transistor 202 for programming a shutter positive voltage and the nMOS transistor 203 for programming a shutter negative voltage.

Although it is necessary to simplify a pixel circuit in order to be compatible with high definition of an image display device, a cascode transistor is essential for high reliability in a pixel circuit of a conventional mechanical shutter type image display device. However, simultaneously attaining both high definition and high reliability was difficult.

That is, accomplishment of both high definition and high reliability as a result of the simplification of a pixel circuit while maintaining high image quality which is the asset of a conventional mechanical shutter type image display device such as high contrast and good color reproducibility and low power consumption was being demanded.

The present invention was performed as a response to these demands. The aim of the present invention is to provide a technology which can achieve both high definition and high reliability as a result of the simplification of a pixel circuit while maintaining high image quality which is the asset of a conventional mechanical shutter type image display device.

The aim of the present invention described above and other aims and new characteristics will be made clear by the descriptions of the present specification and attached diagrams.

SUMMARY

A summary of a representative invention among the inventions disclosed in the present application is simply explained as follows.

(1) A display device electrically controlling a position of a mechanical shutter of each pixels to display an image includes a plurality of pixels each including the mechanical shutter, a signal line inputting an image signal to each of the pixels, and a scanning line inputting a scanning voltage to each of the pixels. Each of the pixels includes a pixel circuit electrically controlling a position of the mechanical shutter. The pixel circuit includes a first control electrode and a second control electrode which the mechanical shutter is put between, and a first control voltage application circuit for inputting a first control voltage to the first control electrode according to the image signal. The first control voltage application circuit includes an input transistor, and a retaining capacitor and a first transistor. The input transistor has a first current terminals connected to the signal line and a gate connected to the scanning line and a second current terminal. The retaining capacitor has a first terminal to be input with a capacitor control signal and a second terminal connected to the second current terminal of the input transistor. The retaining capacitor retains a voltage input by the input transistor. The first transistor has a gate connected to the second terminal of the retaining capacitor, a first current terminal connected to the first control electrode and a second current terminal to be input with a first control signal. A second control signal is input to the second control electrode. A voltage level of the capacitor control signal, the first control signal and the second control signal are changed at certain timing to control a position of the mechanical shutter.

(2) A display device electrically controlling a position of a mechanical shutter of each pixel to display an image includes a plurality of pixels each including the mechanical shutter, a first signal line inputting a first image signal to each of the pixels, a second signal line inputting a second image signal to each of the pixels, and a scanning line inputting a scanning voltage to each of the pixels. Each of the pixels includes a pixel circuit electrically controlling a position of the mechanical shutter. The pixel circuit includes a first control electrode and a second control electrode which the mechanical shutter is put between, a first control voltage application circuit for inputting a first control voltage to the first control electrode according to the first image signal, and a second control voltage application circuit for inputting a second control voltage to the second control electrode according to the second image signal. The first control voltage application circuit includes a first input transistor, a first retaining capacitor and a first transistor. The first input transistor has a first current terminal connected to the first signal line and a gate connected to the scanning line and a second current terminal. The first retaining capacitor has a first terminal to be input with a capacitor control signal and a second terminal connected to the second current terminal of the first input transistor. The first retaining capacitor retains a voltage input by the first input transistor. The first transistor has a gate connected to the second terminal of the first retaining capacitor, a first current terminal connected to the first control electrode and a second current terminals input with a control signal. The second control voltage application circuit includes a second input transistor, a second retaining capacitor and a second transistor. The second input transistor has a first current terminal connected to the second signal line and a gate connected to the scanning line. The second retaining capacitor has a first terminal to be input with a capacitor control signal and a second terminal connected to the second current terminal of the second input transistor. The second retaining capacitor retains a voltage input by the second input transistor. The second transistor has a gate connected to the second terminal of the second retaining capacitor, a first current terminal connected to the second control electrode and a second current terminal to be input with the control signal. A voltage level of the capacitor control signal and the control signal are changed at certain timing to control a position of the mechanical shutter.

(3) A flat light source, a transparent substrate and a light blocking film including an optical aperture region corresponding to each pixel arranged on the transparent substrate, and blocking light emitted from the light source at a regions other than the optical aperture may be included in (1) or (2) and the mechanical shutter may be arranged corresponding to the optical aperture region on the transparent substrate.

DESCRIPTION OF EMBODIMENTS

The preferred embodiments applied with present invention are explained below with referring to the accompanying drawings. Furthermore, the present invention is not limited to the embodiments explained below and various changes and modifications may be made without departing from the scope of the appended claims.

Furthermore, in all the diagrams for explaining the embodiments the same symbols are provided to those components having the same functions and repeated explanations are omitted. In addition, the embodiments below are not intended to restrict an interpretation of the scope of the patent claims of the present invention.

First Embodiment

Figure 1:
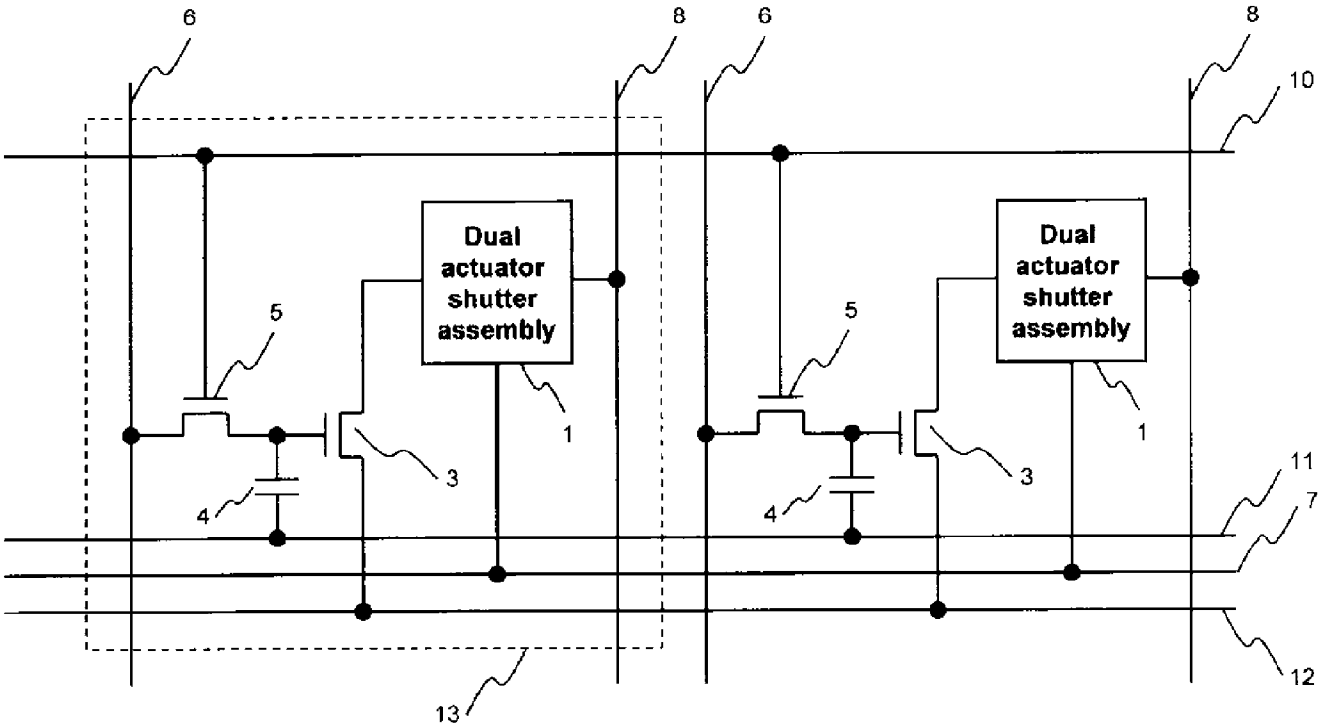
FIG. 1 is a circuit diagram which shows a pixel circuit of a mechanical shutter type image display device according to a first embodiment of the present invention.

FIG. 1 is a circuit diagram which shows a pixel circuit of a mechanical shutter type image display device according to a first embodiment of the present invention.

Figure 2:
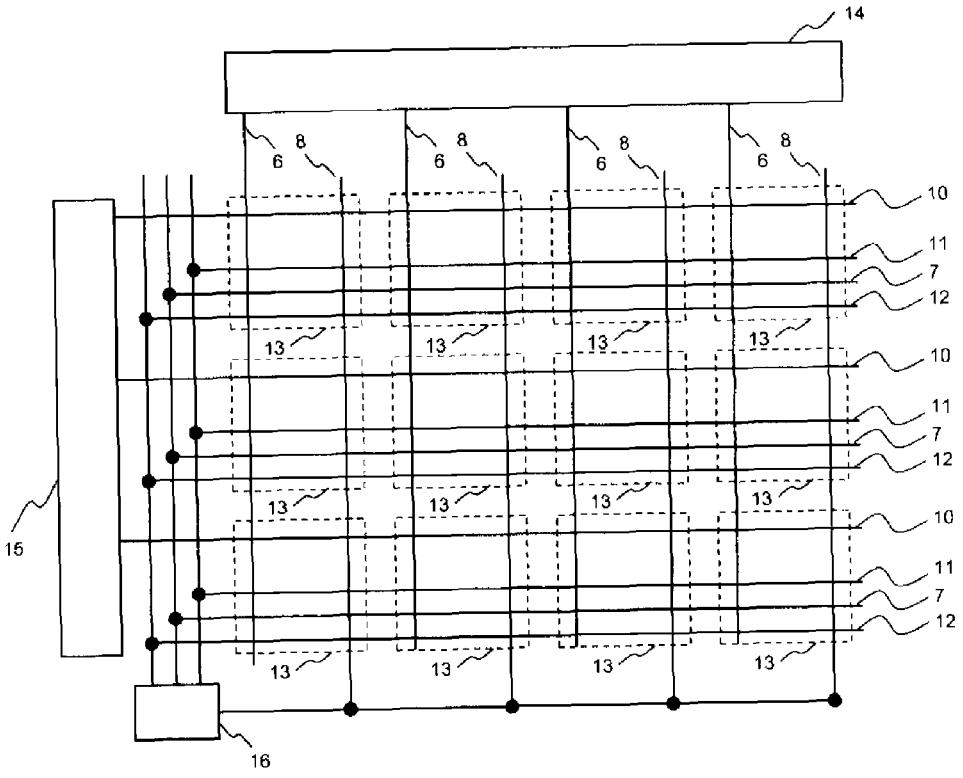
FIG. 2 is a block diagram which shows an approximate structure of a mechanical shutter type image display device according to a first embodiment of the present invention.

FIG. 2 is a block diagram which shows an approximate structure of a mechanical shutter type image display device according to a first embodiment of the present invention.

Figure 3:
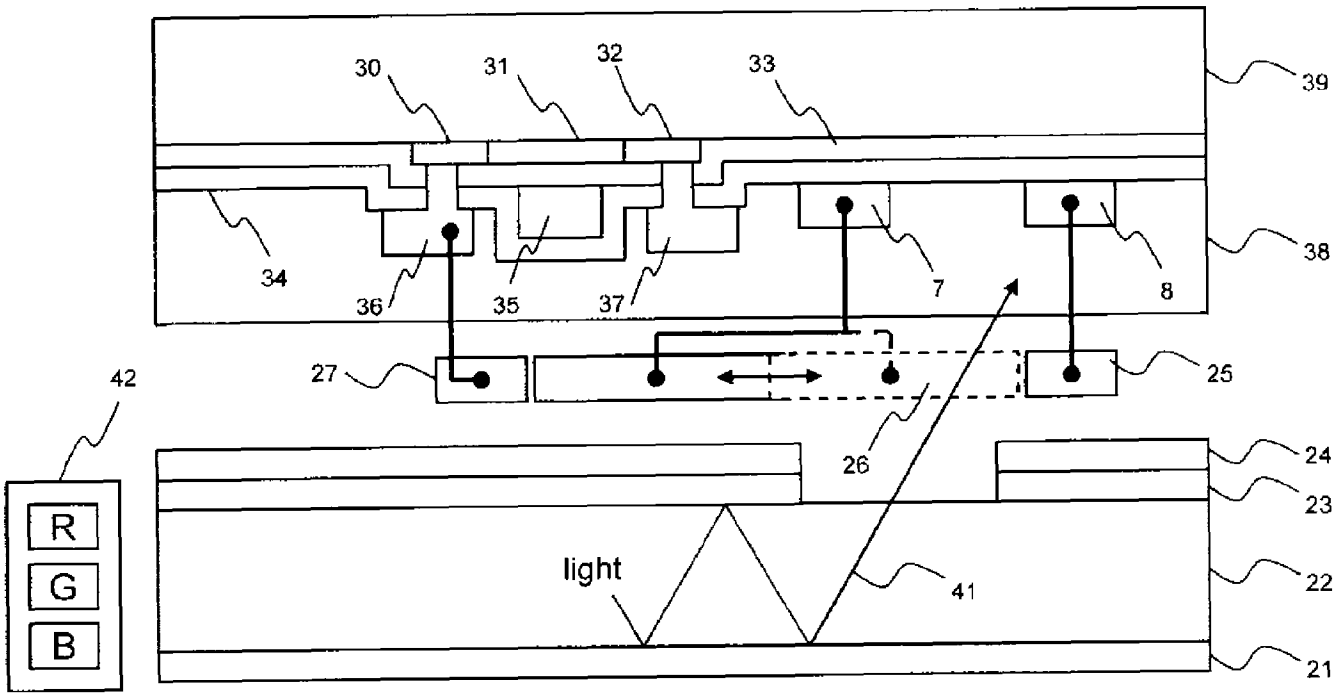
FIG. 3 is a cross sectional diagram which shows a cross sectional structure of a pixel section of a mechanical shutter type image display device according to a first embodiment of the present invention.

FIG. 3 is a cross sectional diagram which shows a cross sectional structure of a pixel section of a mechanical shutter type image display device according to a first embodiment of the present invention.

A pixel circuit of the mechanical shutter type image display device of the present embodiment is explained below with reference to FIG. 1 to FIG. 3.

A signal line 6 is connected to each pixel 13. Specifically, the signal line 6 and a signal retaining capacitor (corresponding to a storage capacitor of the present invention) 4 are connected via a scanning switch (corresponding to an input transistor of the present invention) 5. The signal retaining capacitor 4 is further connected to a gate of transistor (corresponding to a first transistor of the present invention) 3 for programming a TFT electrode. The drain of the transistor 3 for programming a TFT electrode is connected to a TFT electrode which is one of two control electrodes of a dual actuator shutter assembly 1. A global electrode which is the other control electrode of the dual actuator shutter assembly 1 is connected to a global control line 8. A shutter electrode of the dual actuator shutter assembly 1 is connected to a shutter electrode control line 7.

Furthermore, the other end of the signal retaining capacitor 4 is connected to a capacitor control line 11. A source of the transistor 3 for programming a TFT electrode is connected to a TFT electrode source control line 12. A gate of the scanning switch 5 is connected to a scanning line 10.

In addition, the dual actuator shutter assembly 1 described above is arranged facing an aperture punctured into a light blocking surface as is explained with reference to FIG. 3 below.

Next, a circuit mounted on the periphery of a pixel 15 of the image display device applied with a mechanical shutter according to the present embodiment is explained.

As is shown in FIG. 2, pixels 13 arranged in a matrix structure form a display region. Signal lines 6 and global control lines 8 laid in a column direction of the matrix, scanning line 10, capacitor control line 11, shutter electrode control line 7 and TFT electrode source control line 12 laid in a row direction are connected to each pixel 13 respectively.

In the periphery of the display region, one end of each signal line 6 is connected to one image signal voltage programming circuit 14 and one end of the global control line 8, capacitor control line 11, shutter electrode control line 7 and TFT electrode source control line 12 are each connected to one control electrode driving circuit 16 respectively. One end of each scanning line 10 is connected to one scanning circuit 15.

Furthermore, although the display region is described using a matrix comprised of 4×3 pixels in order to simplify explanation in FIG. 2, it is clear that the technological ideas disclosed by the present invention does not limit the number of pixels.

Next, a cross sectional structure of a pixel section of the image display device applied with a movable type shutter according to the present embodiment is explained.

As is shown in FIG. 3, a polycrystalline silicon thin film 31, polycrystalline silicon thin films (30, 32) doped with a high concentration of n type dopants, a gate insulation film 33, a gate electrode 35 formed from a high melting point metal, and a polycrystalline silicon thin film transistor formed from a source electrode 37 and a drain electrode 36 are arranged on a glass substrate 39. This corresponds to the transistor 3 for programming a TFT electrode.

Furthermore, the shutter electrode control line 7 and a part of the global control line 8 are formed in an AL wiring layer same as the source electrode 37 and the drain electrode 36 sandwiching an insulation protection film 34 on the glass substrate 39. These are covered by a protection film 38 comprised from a multilayer of silicon nitride and an organic material.

A dual actuator shutter assembly 1 including a shutter electrode 26 and two control electrodes which are a shutter electrode 26 and a TFT electrode 27 are arranged on the protective film 38. The shutter electrode 26 is connected to the shutter electrode control line 7, the drain electrode 36 is connected to the TFT electrode 27, and the global control line 8 is connected to the global electrode 25 each via a contact hole. An insulation film is formed on each surface of the shutter electrode 26, the TFT electrode 27 and the global electrode 25 which are control electrodes in order to prevent shorts when each component contacts with each other.

Here, because the position of an electric field produced by the difference between a voltage applied to the shutter electrode 26 and each voltage applied to the TFT electrode 27 and global electrode 25 is controlled, the scope of variation of the position of the shutter electrode 26 is shown using a dotted line in FIG. 3.

In addition, although not shown in FIG. 3, other transistors arranged within the pixel 13 are similarly formed from a polycrystalline silicon thin film transistor. These polycrystalline silicon thin film transistors are formed using a known excimer laser annealing process etc.

A light guide plate 22 which includes a light source 42 comprising red, blue and green independent LED light sources is arranged on the opposite side of the glass substrate 39 seen from the shutter electrode 26. A reflective films (22, 23) are formed on both surfaces of the light guide plate 22. Furthermore, a black film 24 is formed on the reflective film 23 facing the shutter electrode 26. The reflective films (21, 23) are metal films of Ag or AL etc. The black film 24 is formed by a metal oxide film or by dispersing an appropriate amount of colorant particles such as carbon black or titanium black in polyimide resin.

Here, an aperture is arranged in a position corresponding to the shutter electrode 26 in the reflective film 23 and black film 24 as is shown in FIG. 3. One part of a light 41 which is emitted from the light source 42 and passes through the light guide plate 22 is emitted from the aperture towards the shutter electrode 26. The black film 24 is arranged in order to prevent reflection of external light.

Hereinafter, the operation of the image display device applied with a movable type shutter according to the present embodiment is explained with reference to FIG. 4 through FIG. 7.

First, the operation of a pixel circuit according to the present embodiment shown in FIG. 1 is explained.

Figure 4:
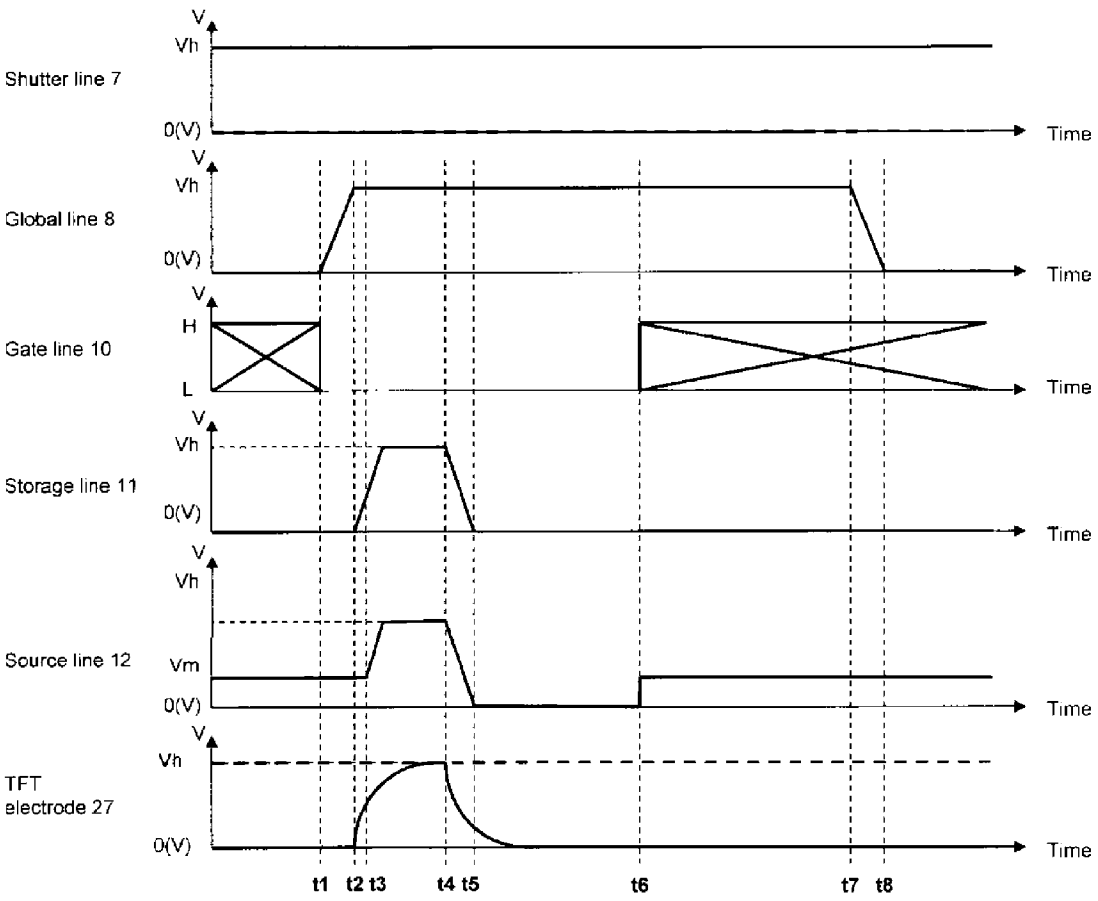
FIG. 4 is an operation timing chart (polarity inversion: shutter=high voltage) of a mechanical shutter type image display device according to a first embodiment of the present invention.
Figure 5:
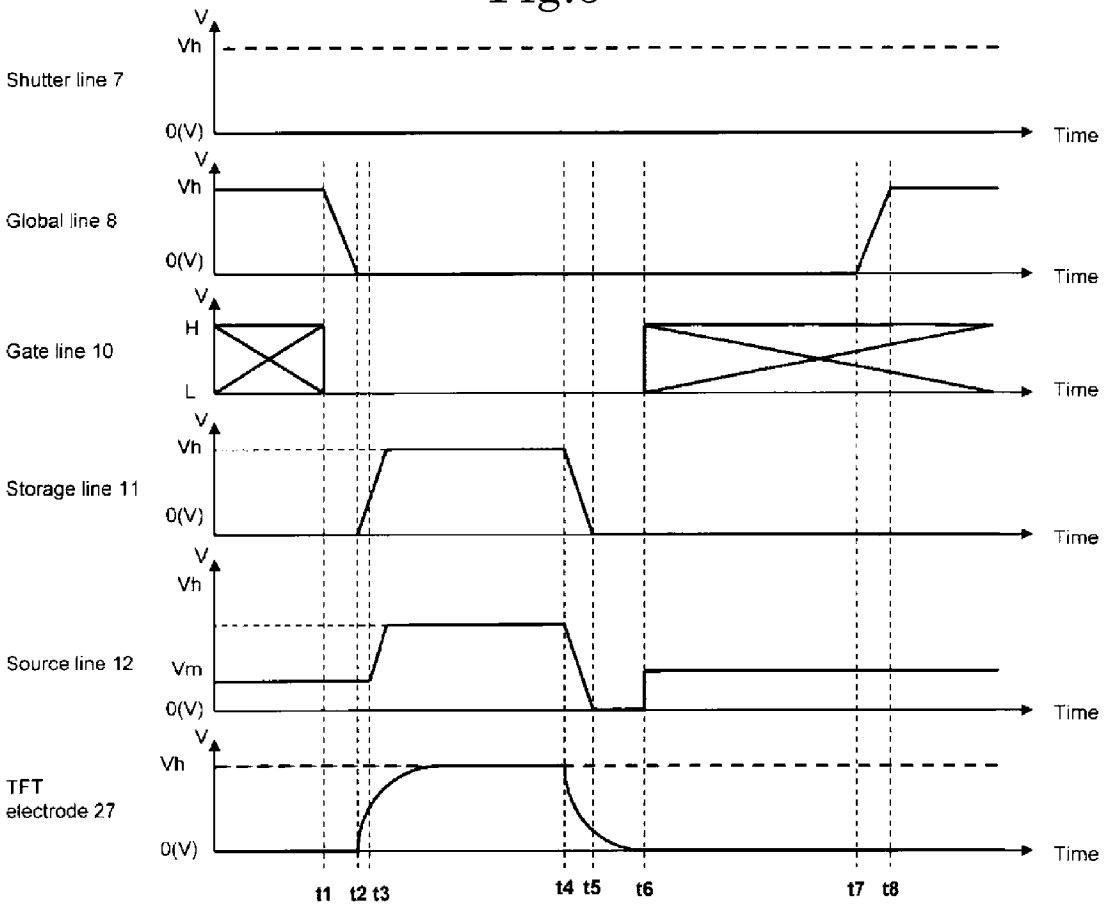
FIG. 5 is an operation timing chart (polarity inversion: shutter=low voltage) of a mechanical shutter type image display device according to a first embodiment of the present invention.

FIG. 1 and FIG. 5 are operation timing charts of a pixel circuit of an image display device applied with a movable type shutter according to the present embodiment of the present invention with time on the horizontal axis and a voltage of each part on the vertical axis. A voltage of the shutter electrode control line 7 is a high voltage Vh (for example 20V) in FIG. 4 and usually 0V in FIG. 5. This corresponds to an inversion (polarity inversion) operation of a drive voltage of the dual actuator shutter assembly 1.

In the image display device according to the present embodiment, 1 frame is divided into 8×RGB=24 or more sub-frames in order to express a full color 8 bit gradation by opening and closing of a shutter and PWM (Pulse Width Modulation) is performed by making a time period of each sub-frame different to control the gradation. At this time, polarity inversion driving is performed for each of a certain number of sub-frames and deterioration of an electrode of the dual actuator shutter assembly 1 is avoided.

In addition, because a voltage of the TFT electrode 27 of the dual actuator shutter assembly 1 described on the lowest level takes one of two vales, about 0V and about Vh (Specifically, Vh or Vh-Vth, in which Vth are threshold voltages of the transistor 3 for programming a TFT electrode), the former is shown by a solid line and the latter is shown by a dotted line in order to easily understand the diagram.

First, an operation at a polarity with which voltage of the mechanical shutter is high is explained.

FIG. 4 is a timing chart of an operation at a polarity with which voltage of the mechanical shutter is high.

(1) Up to Time (t1)

Programming of an image signal voltage to a pixel is performed in this time period. A voltage applied to the global control line 8 and the capacitor control line 11 is 0V and an intermediate voltage Vm (for example 5V) is applied to the TFT electrode source control line 12. The scanning switch 5 which is selected by scanning scanning lines 10 in sequence for each row is temporarily turned ON and a signal voltage supplied from the TFT electrode source control line 12 is programmed to the signal retaining capacitor 4. A signal voltage is 5V or 0V for example. However, because an intermediate voltage Vm of 5V is applied to the TFT electrode source control line 12, the transistor 3 for programming a TFT electrode is not turned ON.

(2) From Time (t1) to (t2)

A voltage of the global electrode control line 8 changes to a high voltage Vh (20V for example) during this time period. Because a voltage of the shutter electrode is usually a high voltage Vh (for example 20V), in the case where the shutter electrode 26 is attracted to the global electrode 25 up to time (t1), the shutter electrode 26 moves in a direction away from the global electrode 25 in response to a change in the voltage of the global electrode control line 8 described above. Furthermore, there is no particular change in the case where the shutter electrode 26 is attracted to the TFT electrode 27 up to time (t1).

(3) From Time (t2) to (t3)

A voltage applied to the capacitor control line 11 begins to sweep from 0V towards a high voltage Vh (20V for example).

(4) From Time (t3) to (t4)

At the same time the voltage of the capacitor control line 11 reaches an intermediate voltage Vm (for example 5V), a voltage applied to the TFT electrode source control line 12 also begins to sweep from the intermediate voltage Vm to a high voltage Vh (for example 20V). In this way, the voltage applied to the capacitor control line 11 and the voltage applied to the TFT electrode source control line 12 reach a high voltage Vh (20V) at the same time and subsequently stop. With this operation the voltage applied to the TFT electrode 27 also rises and in the case where 5V is programmed to the signal retaining capacitor 4 of the pixel 13 as is described below, the voltage of the TFT electrode 27 converges to Vh-Vth (Vth is a threshold voltage of the transistor 3 for programming a TFT electrode).

In this way, in the case where the shutter electrode 26 is attracted to the TFT electrode 27 up to time (t2), the shutter electrode 26 moves in a direction away from the TFT electrode 27.

(5) From Time (t4) to (t5)

The voltages of the capacitor control line 11 and the TFT electrode source control line 12 begin to sweep to 0V simultaneously and subsequently stop. With this operation, in the case where the signal retaining capacitor 4 of the pixel 13 is programmed with 5V as described below, the voltage of the TFT electrode 27 drops to 0V, and in the case where the signal retaining capacitor 4 is programmed with 0V, the voltage of the TFT electrode 27 is maintained at Vh-Vth (Vth is a threshold voltage of the transistor 3 for programming a TFT electrode).

(6) From Time (t5) to (t6)

The voltages of capacitor control line 11 and the TFT electrode source control line 12 stop at 0V and in the case where 5V is programmed to the signal retaining capacitor 4 of this pixel in this time period, the shutter electrode 26 is attracted to the TFT electrode 27. However, in the case where 0V is programmed to the signal retaining capacitor 4, the shutter electrode 26 is not attracted to the TFT electrode 27. In order to make sure the shutter 24 is attracted to the TFT electrode 27, it is necessary to make sure this time period is 100μ seconds or more.

(7) From Time (t6) to (t7)

Programming of an image signal voltage to a pixel 13 begins at the same time as when an intermediate voltage Vm (5V for example) is applied to the TFT electrode source control line 12. The scanning switch 5 which is selected by scanning scanning lines 10 in sequence for each row is temporarily turned ON and a signal voltage supplied from the TFT electrode source control line 12 is programmed to the signal retaining capacitor 4. A signal voltage is 5V or 0V for example. However, because an intermediate voltage Vm of 5V is again applied to the TFT electrode source control line 12, the transistor 3 for programming a TFT electrode is not turned ON.

(8) From Time (t7) to (t8)

A voltage of the global electrode control line 8 recovers from a high voltage Vh (20V for example) to 0V during this time period. Because a voltage of the shutter electrode is usually a high voltage Vh (for example 20V), in the case where the shutter electrode 26 is attracted to the TFT electrode 27 from time (t5) to time (t6), the shutter electrode 26 is attracted to the global electrode 25. However, in the case where the shutter electrode 26 is already attracted to the TFT electrode 27 from time (t5) to time (t6), the shutter electrode 26 is not attracted to the global electrode 25.

(9) After Time (t8)

After a period of time, 100μ seconds for example, required for attracting the shutter electrode 26 to the global electrode 25 has elapsed, the corresponding independent LED light sources within the light source 42 are made to emit light.

Next, an operation at an inverted polarity with which voltage of the mechanical shutter is low is explained. FIG. 5 is a timing chart of an operation at an inverted polarity with which voltage of the mechanical shutter is low.

(1) Up to Time (t1)

Programming of an image signal voltage to a pixel is performed in this time period. A voltage applied to the global control line 8 is a high voltage Vh (20V for example), a voltage applied to the capacitor control line 11 is 0V and an intermediate voltage Vm (for example 5V) is applied to the TFT electrode source control line 12. The scanning switch 5 which is selected by scanning scanning lines 10 in sequence for each row is temporarily turned ON and a signal voltage supplied from the TFT electrode source control line 12 is programmed to the signal retaining capacitor 4. A signal voltage is 5V or 0V for example. However, because a 5V intermediate voltage Vm is applied to the TFT electrode source control line 12, the transistor 3 for programming a TFT electrode is not turned ON.

(2) From Time (t1) to (t2)

A voltage of the global electrode control line 8 changes to a low voltage 0V during this time period. Because the shutter electrode is usually a low voltage 0V, in the case where the shutter electrode 26 is attracted to the global electrode 25 up to time (t1), the shutter electrode 26 moves in a direction away from the global electrode 25 in response to a change in the voltage of the global electrode control line 8 described above. Furthermore, there is no particular change in the case where the shutter electrode 26 is attracted to the TFT electrode 27 up to time (t1).

(3) From Time (t2) to (t3)

A voltage applied to the capacitor control line 11 begins to sweep from 0V towards a high voltage Vh (20V for example).

(4) From Time (t3) to (t4)

At the same time the voltage of the capacitor control line 11 reaches an intermediate voltage Vm (for example 5V), a voltage applied to the TFT electrode source control line 12 also begins to sweep from the intermediate voltage Vm to a high voltage Vh (for example 20V).

In this way, the voltage applied to the capacitor control line 11 and the voltage applied to the TFT electrode source control line 12 reach a high voltage Vh (20V) at the same time and subsequently stop.

With this operation the voltage applied to the TFT electrode 27 also rises and in the case where 5V is programmed to the signal retaining capacitor 4 of the pixel 13 as is described below, the voltage of the TFT electrode 27 reaches a high voltage Vh (20V for example) and in the case where 0V is programmed to the signal retaining capacitor 4, the voltage of the TFT electrode 27 converges to Vh-Vth (Vth is a threshold voltage of the transistor 3 for programming a TFT electrode).

In this way, because the shutter electrode 26 of which voltage is normally a low voltage 0V is attracted to the TFT electrode 27, it is necessary to make sure this time period is 100μ seconds or more for example.

(5) From Time (t4) to (t5)

The voltages of the capacitor control line 11 and the TFT electrode source control line 12 sweep to 0V simultaneously and subsequently stop. With this operation, in the case where the signal retaining capacitor 4 of the pixel 13 is programmed with 5V as described below, the voltage of the TFT electrode 27 drops to 0V, and in the case where the signal retaining capacitor 4 is programmed with 0V, the voltage of the TFT electrode 27 is maintained at Vh-Vth (Vth is a threshold voltage of the transistor 3 for programming a TFT electrode).

(6) From Time (t5) to (t6)

The voltages of capacitor control line 11 and the TFT electrode source control line 12 stop at 0V and in the case where 5V is programmed to the signal retaining capacitor 4 of this pixel in this time period, the shutter electrode 26 is attracted to the TFT electrode 27. However, in the case where 0V is programmed to the signal retaining capacitor 4, the shutter electrode 26 is still attracted to the TFT electrode 27.

(7) From Time (t6) to (t7)

Programming of an image signal voltage to a pixel 13 begins at the same time as when an intermediate voltage Vm (5V for example) is applied to the TFT electrode source control line 12. The scanning switch 5 which is selected by scanning scanning lines 10 in sequence for each row is temporarily turned ON and a signal voltage supplied from the TFT electrode source control line 12 is programmed to the signal retaining capacitor 4. A signal voltage is 5V or 0V for example. However, because an intermediate voltage Vm of 5V is again applied to the TFT electrode source control line 12, the transistor 3 for programming a TFT electrode is not turned ON.

(8) From Time (t7) to (t8)

A voltage of the global electrode control line 8 recovers from a low voltage 0V to a high voltage (0V for example) during this time period. Because the shutter electrode is usually a low voltage 0V, in the case where the shutter electrode 26 is away from the TFT electrode 27 from time (t5) to time (t6), the shutter electrode 26 is attracted to the global electrode 25. However, in the case where the shutter electrode 26 is still attracted to the TFT electrode 27 from time (t5) to time (t6), the shutter electrode 26 is not attracted to the global electrode 25.

(9) After Time (t8)

After a period of time, 100μ seconds for example, required for attracting the shutter electrode 26 to the global electrode 25 has elapsed, the corresponding independent LED light sources within the light source 42 are made to emit light.

In the explanation above, it is described that the control voltage applied to the TFT electrode 27 being different was described using the case where 5V and the case where 0V are programmed to the signal retaining capacitor 4 of the pixel. However, applying a signal voltage to the TFT electrode 27 described above is described in detail below with reference to FIG. 6 and FIG. 7.

Figure 6:
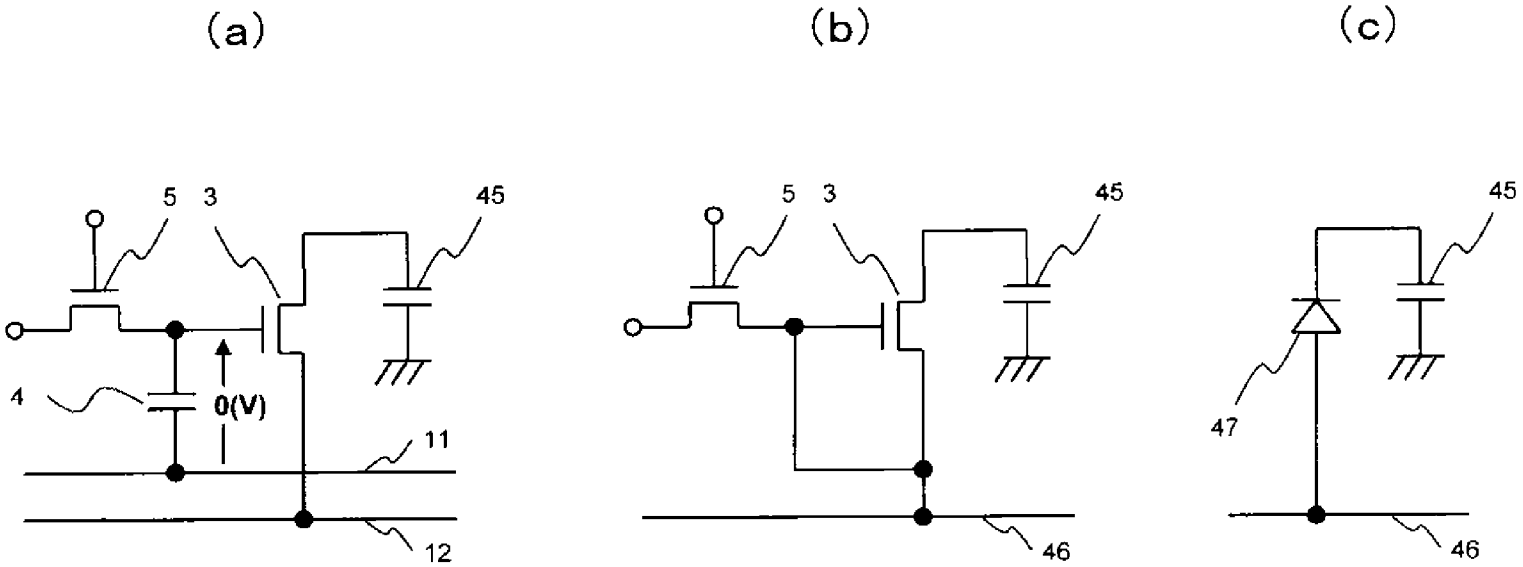
FIG. 6 is a diagram for explaining programming of a control signal voltage to a TFT electrode when an image signal voltage is a Low level voltage (for embodiment 0V) in a mechanical shutter type image display device according to a first embodiment of the present invention.

FIG. 6 is a diagram for explaining the application of a signal voltage to the TFT electrode 27 in the case where an image signal voltage programmed to the signal retaining capacitor 4 is a Low level voltage (0V for example).

FIG. 6(*a*) is an equivalent circuit diagram of a pixel 13 in the case where a Low level voltage (0V for example) is applied to the signal retaining capacitor at the start of this period, where an equivalent input capacitor 45 of the TFT electrode 27 is drawn in place of the TFT electrode 27.

It is assumed that the capacitor control line 11 and the TFT electrode source control line 12 are operated simultaneously during this period. In this assumption, as is shown in the equivalent circuit of FIG. 6(*b*), the signal retaining capacitor 4 which is programmed with 0V is equivalent to a circuit where both electrodes thereof short circuit with each other since both ends are the same voltage, and the capacitor control line 11 and the TFT electrode source control line 12 can be considered together as one equivalent wire 46.

Then, because the transistor 3 for programming a TFT electrode is a diode connected transistor, whole of the pixel 13 can be considered as a circuit having a structure in which the equivalent input capacitor 45 of the TFT electrode 27 is connected to the equivalent wire 46 via an equivalent diode 47 of the transistor 3 for programming a TFT electrode as is shown in the equivalent circuit of FIG. 6(*c*). As the equivalent circuit shown in FIG. 6(*c*), when Vh (20V for example) is simultaneously applied to the capacitor control line 11 and the TFT electrode source control line 12, the equivalent diode 47 is turned ON, (Vh-Vth) (Vth is a threshold voltage of the transistor 3 for programming a TFT electrode) is applied to the equivalent input capacitor 45 of the TFT electrode 27 as a signal voltage, thereafter, even if 0V is applied simultaneously to the capacitor control line 11 and the TFT electrode source control line 12, the TFT electrode 27 is maintained at (Vh-Vth) as a control signal voltage.

Furthermore, instead of operating the capacitor control line 11 and the TFT electrode source control line 12 simultaneously, the TFT electrode source control line 12 may be operated after a slight delay after the capacitor control line 11 operated.

Figure 7:
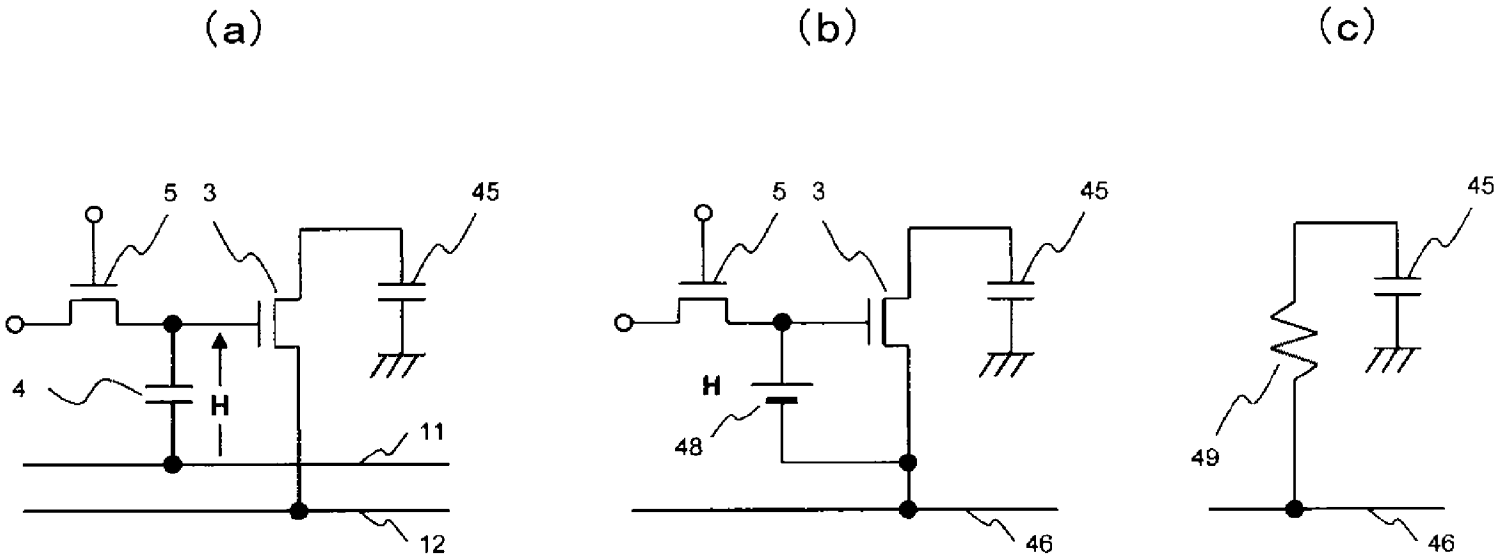
FIG. 7 is a diagram for explaining programming of a control signal voltage to a TFT electrode when an image signal voltage is a High level voltage (for embodiment 5V) in a mechanical shutter type image display device according to a first embodiment of the present invention.

Next, FIG. 7 is a diagram for explaining the application of a signal voltage to the TFT electrode 27 in the case where an image signal voltage programmed to the signal retaining capacitor 4 is a High level voltage (5V for example).

FIG. 7(*a*) is an equivalent circuit diagram of a pixel 13 in the case where a High level voltage (5V for example) is applied to the signal retaining capacitor at the start of this period, where an equivalent input capacitor 45 of the TFT electrode 27 is drawn in place of the TFT electrode 27.

It is assumed that the capacitor control line 11 and the TFT electrode source control line 12 are operated simultaneously during this period. In this assumption, as is shown in the equivalent circuit of FIG. 7(*b*), the signal retaining capacitor 4 which is programmed with 5V is equivalent to a direct current power supply 48 of which output is 5V and the capacitor control line 11 and the TFT electrode source control line 12 can be considered together as one equivalent wire 46.

Then, because the transistor 3 for programming a TFT electrode of which gate is connected to a 5V direct current power supply 48 can be considered as an equivalent resistor 49 since it is usually turned ON, whole of the pixel 13 can be considered as a circuit having a structure in which the equivalent input capacitor 45 of the TFT electrode 27 is connected to the equivalent wire 46 via the equivalent resistance 49 of the transistor 3 for programming a TFT electrode. As the equivalent circuit shown in FIG. 7(*c*), when Vh (20V for example) is simultaneously applied to the capacitor control line 11 and the TFT electrode source control line 12, Vh is once applied to the equivalent input capacitor 45 of the TFT electrode 27 via the equivalent resistance 49 as a signal voltage, thereafter, when 0V is applied simultaneously to the capacitor control line 11 and the TFT electrode source control line 12, the equivalent input capacitor 45 of the TFT electrode 27 is again applied with 0V via the equivalent resistance 49.

Furthermore, as mentioned above, instead of operating the capacitor control line 11 and the TFT electrode source control line 12 simultaneously, the TFT electrode source control line 12 may be operated after a slight delay after the capacitor control line 11 operated.

Here, the higher a High level signal voltage programmed to the signal retaining capacitor 4 is, the faster an application operation to the equivalent input capacitor 45 via the transistor 3 for programming a TFT electrode is. However, a problem also arises whereby power consumption rises when a High level signal voltage applied to a signal line 6 from an image signal voltage programming circuit 14.

In addition, after 0V is applied to the TFT electrode 27, an intermediate voltage Vm is applied to the TFT electrode source control line 12 so that the TFT electrode 27 is not turned ON. However, the voltage applied to the TFT electrode 27 actually leaks so that it falls down to the value (Vh-Vth) which is lower than the High level signal voltage programmed to the signal retaining capacitor 4. Because of this, it is preferred to not set the High level signal voltage too high, for example from 7V to 5V is preferred.

Next, the operation of the pixel periphery circuit shown in FIG. 2 is explained. In a time period an image signal voltage is programmed to a pixel which is equivalent to that until time (t1) described above, the scanning lines 10 are scanned in sequence by a scanning circuit 15 and an image signal voltage is simultaneously applied to the signal line 6 from the image signal voltage programming circuit 14. Here, as mentioned above, the present embodiment simultaneously performs PWM (Pulse Width Modulation) driving which makes the time period of each sub-frame is made different to control gradation and field sequential driving for changing the color of emitted light for each sub-frame.

As a result, the image signal voltage applied to the signal line 6 from the image signal voltage programming circuit 14 has 2 values, 0V and 5V for example, and thereby a control voltage applied to the TFT electrode 27 arranged on each pixel 13 is controlled.

Furthermore, whether whitely displaying or darkly displaying corresponds to either 5V or 0V respectively is controlled in accordance with a value of a voltage applied to the shutter electrode control line 7 for inversion driving of the shutter 26, as already described above. In addition, the voltages applied to the global control line 8, the capacitor control line 11, the shutter electrode control line 7 and the TFT electrode source control line 12 are controlled as described above by the control electrode driving circuit 16.

Next, the operation of structural components surrounding the shutter electrode 26 shown in FIG. 3 is explained. As described above, the shutter electrode 26 is sucked by the electrostatic attractive force of either the TFT electrode 27 or the global electrode 25 and is stable in this state.

Here, in the case where the shutter electrode 26 is pulled to the side of the global electrode 27, the shutter electrode 26 becomes stable on the aperture of the reflection film 23 and the black film 24. Therefore, the light 41 which is emitted from the light source 42 and passes through the light guide plate 22 is returned again to the light guide plate by being reflected by the shutter 26 even if the light is emitted from the aperture. Consequently, the pixel 13 is observed as a non-light emitting state.

In addition, in the case where the shutter 26 is pulled to the side of the TFT electrode 27, the shutter 26 becomes stable in the part where there is no aperture of the reflection film 23 and the black film 24. Consequently, the light 41 which is emitted from the light source 42 and passes through the light guide plate 22 is emitted from the aperture without being blocked by the shutter electrode 26. Therefore, the pixel 13 is observed as a light emitting state.

In the present embodiment, the state where the shutter electrode 26 is attracted to the global electrode 25 side is designed as the shutter being closed. However, it is also possible to design the state where the shutter electrode 26 is attracted to the TFT electrode 27 side as the shutter being closed. However, because image quality deteriorates more in the case where the shutter is not sufficiently closed than the case where the shutter is not sufficiently open, the effect whereby image quality deterioration is avoided and yield can be increased by setting the state where the shutter electrode 26 is attracted to the global electrode 25 which is usually controlled with a low impedance as the shutter being closed.

Furthermore, in the present embodiment, the periods of time when the scanning switch 5 and the transistor 3 for programming a TFT electrode are ON, are each limited to the time period in which the pixel 13 is selected by a scanning line 10 and the application time of a control signal to the TFT electrode 27. In this way, the present invention has the effect whereby it is possible to sufficiently avoid a shift in a threshold voltage caused by long continuous periods when these polycrystalline silicon thin film transistors are ON.

Second Embodiment

Figure 8:
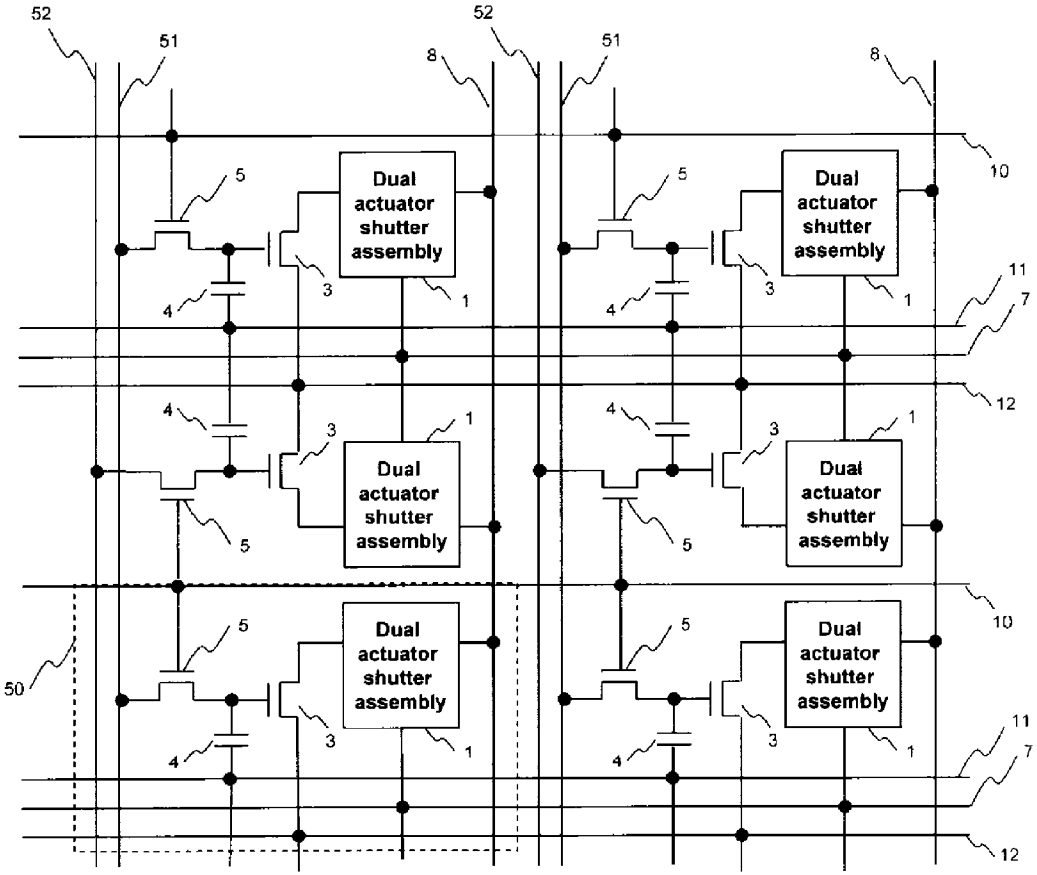
FIG. 8 is a circuit diagram which shows a pixel circuit of a mechanical shutter type image display device according to a second embodiment of the present invention.

FIG. 8 is a circuit diagram which shows a pixel circuit of a mechanical shutter type image display device of the second embodiment of the present invention.

A mechanical shutter type image display device of the second embodiment is explained below with reference to FIG. 8. Because the system structure and operation of the image display device, the structure and operation of the display panel and structure and operation of a pixel etc. in the second embodiment are basically the same as those described in the first embodiment; such explanations are omitted here and an explanation is given only where the structure and operation differ from the first embodiment. A pixel 50 shown in FIG. 8 is the same as the pixel 13 in the first embodiment shown in FIG. 1. However, a scanning line 10 connected to a gate of the scanning switch 5 is shared between two pixels 50 adjacent to each other in a column direction. Similarly, the capacitor control line 11, shutter electrode control line 7 and TFT electrode source control electrode 12 are shared between two pixels 50 adjacent to each other in a column direction, combination of which is different from those for the scanning line 10. Furthermore, the signal lines (41, 52) are arranged in pairs of two, and each scanning switch 5 of adjacent pixels 50 connected to the same scanning line 10 is respectively connected to a signal line (51, 52) different from each other.

In the case where PWM (Pulse Width Modulation) driving which makes the time period of each sub-frame is made different to control gradation and field sequential driving for changing the color of emitted light for each sub-frame are performed simultaneously, there is a problem whereby the scanning speed of a scanning line 10 must be increased. In particular, scanning speed greater than the capability of a scanning circuit is required in a display where the number of pixels in a column direction large. In the second embodiment, because it is possible to program a signal voltage to two pixels adjacent to each other in column direction at one scan of a scanning line 10, it is possible to reduce the number of scanning frequencies of a scanning line 10 by the scanning circuit 15 by half.

Furthermore, it is necessary for the capacitor control line 11 to be stable when programming a signal voltage to a signal retaining capacitor 4. However, when programming a signal voltage to the signal retaining capacitors 4 of two rows of pixels 50 scanned by one scanning line 10, the amount of variation of the capacitor control lines 11 would increase twofold, if the signal retaining capacitors 4 of these two rows were connected to the same capacitor control line 11. Thus, in the present embodiment, a signal shortage capacitors of pixels 50 on two rows which are programmed simultaneously scanned by one scanning line 10 are connected to different capacitor control lines 11 respectively. In this way, the problem described above is avoided.

Third Embodiment

Figure 9:
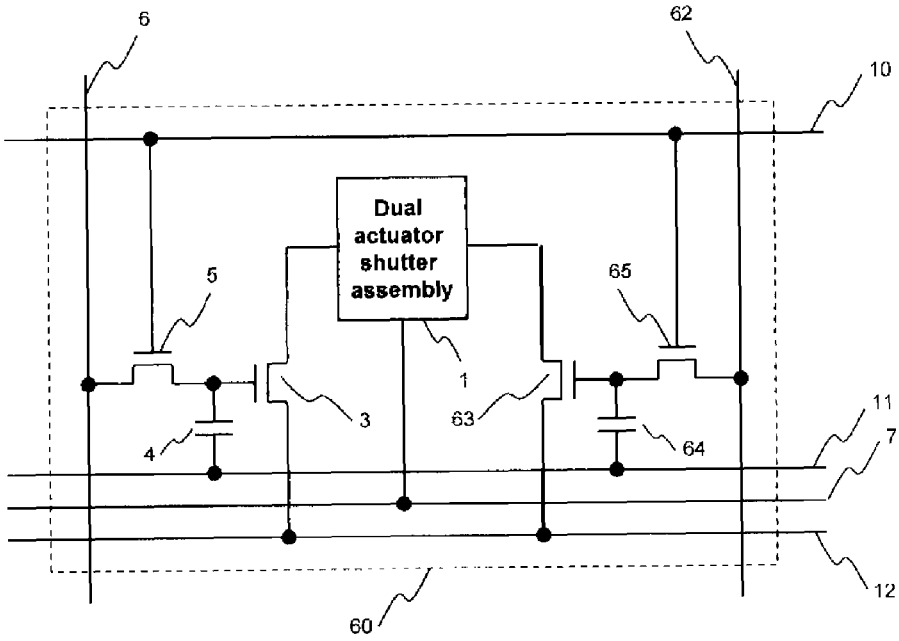
FIG. 9 is a circuit diagram which shows a pixel circuit of a mechanical shutter type image display device according to a third embodiment of the present invention.

FIG. 9 is a circuit diagram which shows a pixel circuit of a mechanical shutter type image display device of a third embodiment of the present invention.

The third embodiment is explained below with reference to FIG. 9.

Because the system structure and operation of the image display device, the structure and operation of the display panel and structure and operation of a pixel etc. in the third embodiment are basically the same as those described in the first embodiment, such explanations are omitted here and an explanation is given only where the structure and operation differs from the first embodiment.

The left half of the pixel 60 shown in FIG. 9 is the same as the pixel 13 of the first embodiment shown in FIG. 1. However, while the global electrode 25 which is one of two control electrodes of the dual actuator shutter assembly 1 in the first embodiment is connected to the global control line 8 in the first embodiment, the global electrode 25 has a similar structure as the TFT electrode 27 in the third embodiment.

In FIG. 9, a second signal line 62 is additionally arranged and the second signal line 62 and a second signal retaining capacitor 64 are connected via a scanning switch 65. The second signal retaining capacitor 64 is further connected to a gate of a transistor 63 for programming a global electrode. A drain of the transistor 63 for programming a global electrode is connected to the global electrode 25.

As is shown in FIG. 9, each gate of the scanning switch 5 and the scanning switch 65 is connected to the a scanning line 10 respectively. The other end of the signal retaining capacitor 4 and the second signal retaining capacitor 64 are respectively connected to the TFT electrode source control line 12. Each source of the transistor 3 for programming a TFT electrode and the transistor 63 for programming a global electrode are respectively connected to the TFT electrode source control line 12.

Because the operation of the present embodiment is the same as the operation of the first embodiment except that voltage of which polarity is reverse to that of the voltage applied to the signal line 6 is applied to the second signal line 62 and that the global electrode 25 is controlled at the same timing as the TFT electrode 27, an explanation of the operation is omitted here.

In the third embodiment, because the global electrode 25 is controlled at the same timing as the TFT electrode 27, it is possible to complete application of a voltage to an electrode at the timing (t6) described in FIG. 4 and FIG. 5 and to extend the time used for emitting light.

In this way, the present embodiment is effective for high intensity/brightness due to being able to further extend light emitting time. In addition, because a control signal input to the TFT electrode 27 and the global electrode 25 becomes complementary, it is possible to more stably operate the shutter 26 with respect to noise etc. Furthermore, the idea of the second embodiment described above can also be applied to the present embodiment.

Fourth Embodiment

Figure 10:
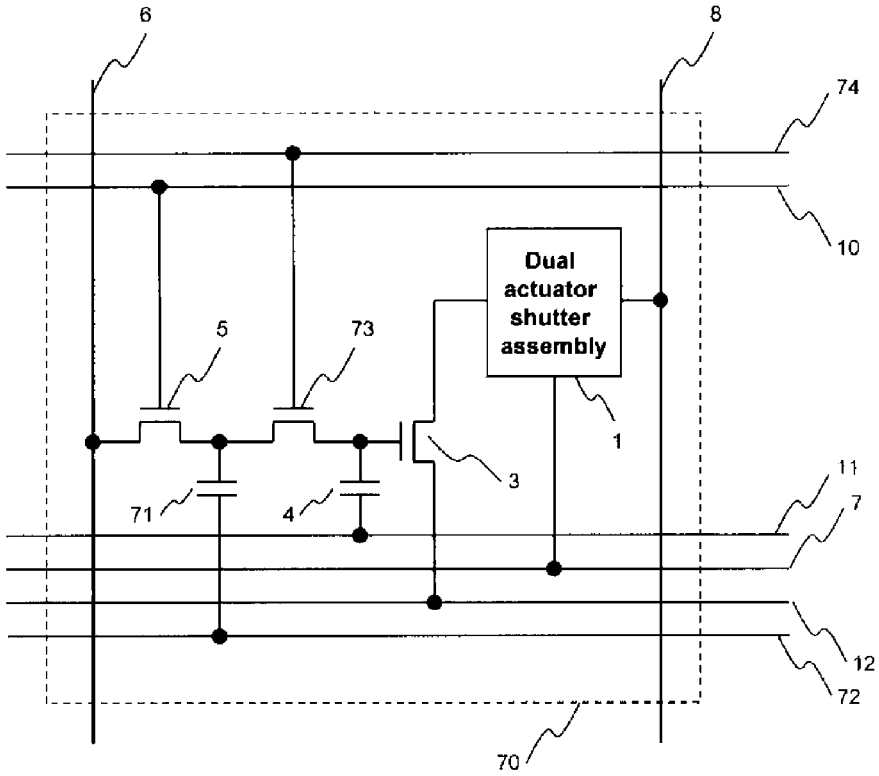
FIG. 10 is a circuit diagram which shows a pixel circuit of a mechanical shutter type image display device according to a fourth embodiment of the present invention.

FIG. 10 is a circuit diagram which shows a pixel circuit of a mechanical shutter type image display device according to a fourth embodiment of the present invention.

Figure 11:
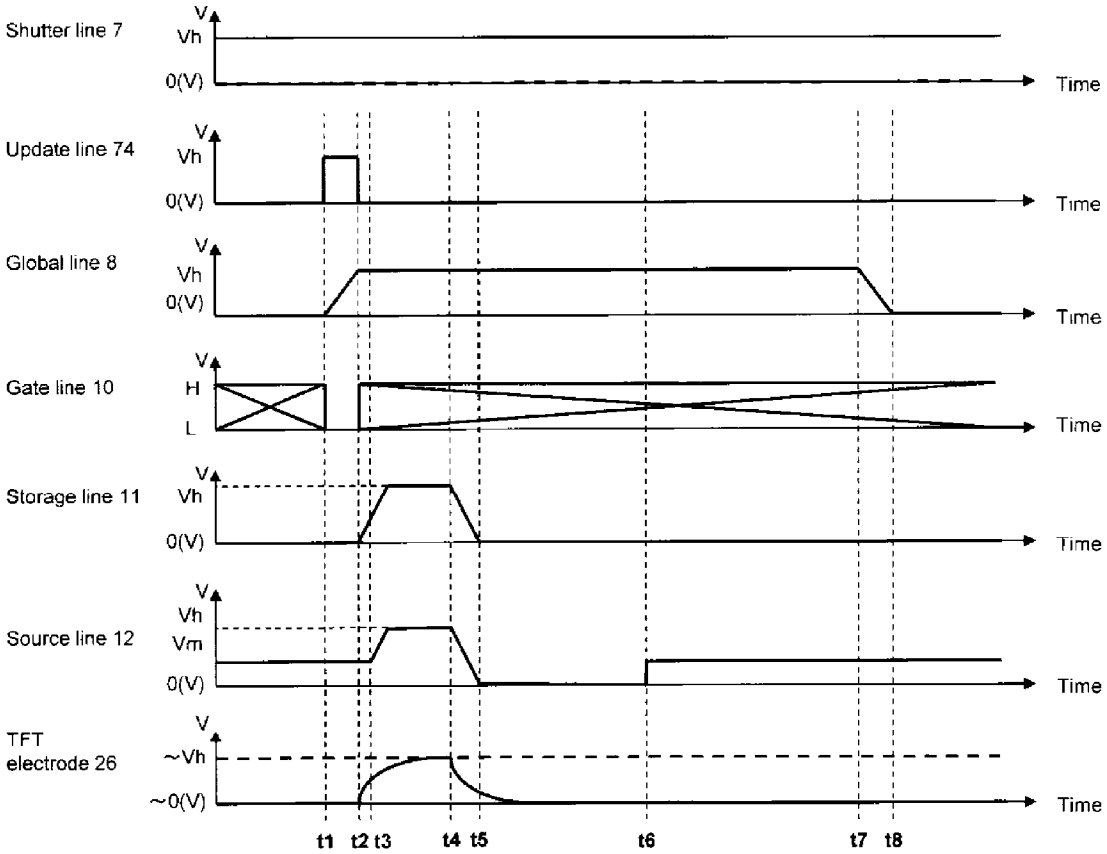
FIG. 11 is an operation timing chart (polarity inversion: shutter=high voltage) of a mechanical shutter type image display device according to a fourth embodiment of the present invention.

FIG. 11 is a timing chart of an operation at an inverted polarity with which voltage of the movable shatter is high in a mechanical shutter type image display device according to a fourth embodiment of the present invention.

Figure 12:
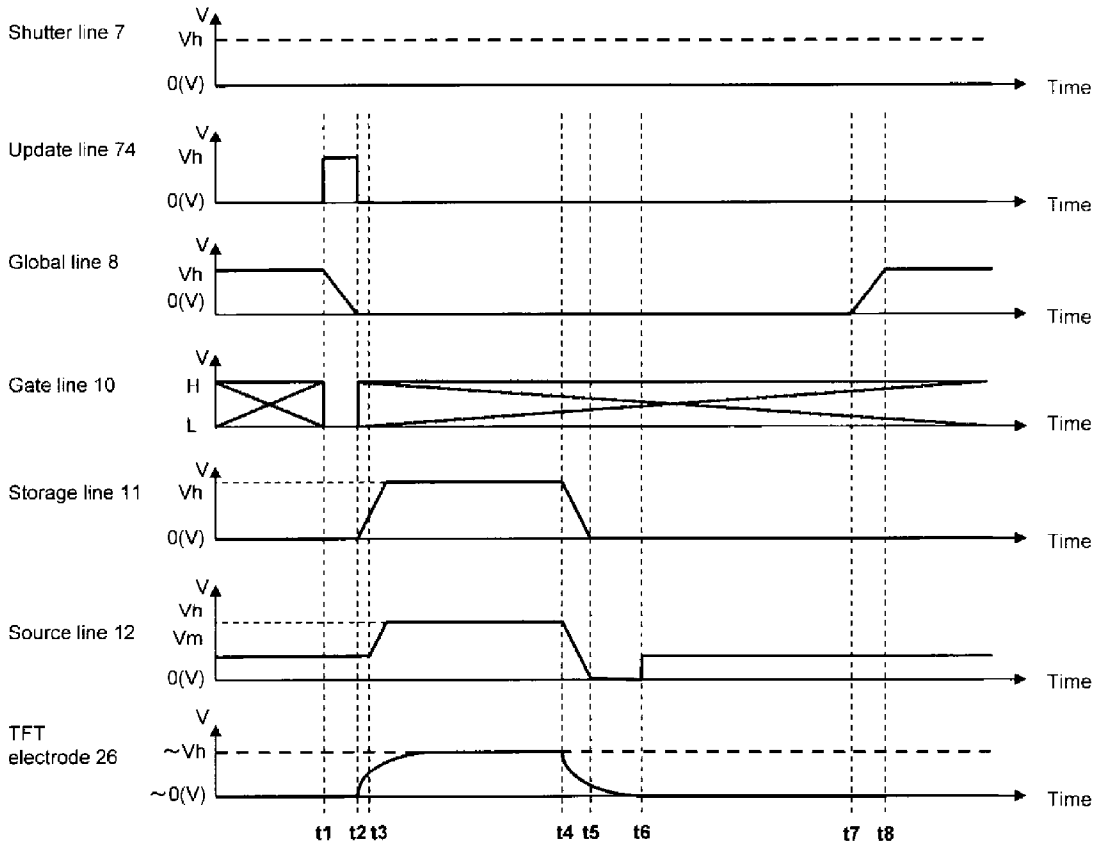
FIG. 12 is an operation timing chart (polarity inversion: shutter=low voltage) of a mechanical shutter type image display device according to a fourth embodiment of the present invention.

FIG. 12 is a timing chart of an operation at an inverted polarity with which voltage of the movable shatter is low in a mechanical shutter type image display device according to a fourth embodiment of the present invention.

The structure and operation of the fourth embodiment are explained below with reference to FIG. 10 through FIG. 12.

First, a pixel circuit of the fourth embodiment is explained.

A signal line 6 is connected to each pixel 70 as is shown in FIG. 10. Specifically, the signal line 6 and a signal programming capacitor 71 are connected via a scanning switch 5. The signal programming capacitor 71 is further connected to the signal retaining capacitor 4 via a signal sending switch 73. The signal retaining capacitor 4 is connected to a gate of transistor 3 for programming a TFT electrode. The drain of the transistor 3 for programming a TFT electrode is connected to a TFT electrode which is one of two control electrodes of a dual actuator shutter assembly 1. A global electrode which is the other control electrode of the dual actuator shutter assembly 1 is connected to a global control line 8. A shutter electrode of the dual actuator shutter assembly 1 is connected to a shutter electrode control line 7.

Furthermore, the other end of the signal retaining capacitor 4 is connected to a capacitor control line 11. A source of the transistor 3 for programming a TFT electrode is connected to a TFT electrode source control line 12. A gate of the scanning switch 5 is connected to a scanning line 10. A gate of the signal sending switch 73 is connected to an update line 74. The other end of the signal programming capacitor 71 is connected to a capacitor ground line 72.

Because a circuit which is mounted on the periphery of the pixel 70 in the fourth embodiment is the same as the first embodiment except that the update line 74 is connected to the control electrode drive circuit 16 and that the capacitor ground line 72 is grounded, such an explanation is omitted. In addition, this is also the same for the cross sectional structure of a pixel section.

Next, the operation of a pixel circuit of the fourth embodiment is explained with reference to FIG. 12.

The operation of a pixel circuit of the fourth embodiment is basically the same as the first embodiment described above. Differences between the operation in the first embodiment and the fourth embodiment are that a time period is arranged during the period from time (t1) to (t2) in which the update line 74 is once switched ON and a signal voltage programmed to the signal programming capacitor 71 is sent to the signal retaining capacitor 4, and that scanning of a scanning line 10 begins at the time (t2).

In the present embodiment, because the signal programming capacitor 71 which is programmed with a signal from the signal line 6, and the signal retaining capacitor 4 which is responsible for driving the transistor 3 for programming a TFT electrode are separated from each other, it is possible to execute driving the transistor 3 for programming a TFT electrode and scanning a scanning line 10 in parallel.

In the fourth embodiment, because it is possible to reduce the number of scanning frequencies of the scanning line 10 by the scanning circuit 15, it is possible to increase the driving margin of the scanning circuit 15 and to improve yield. Furthermore, it is also possible to apply the idea of the second embodiment described above to the present embodiment.

Various modifications can be made to the technologies disclosed in the first embodiment through the fourth embodiment without departing from the purport of the present invention.

In the first through fourth embodiments, while the scanning switch 5 and the transistor 3 for programming a TFT electrode are formed as n type polycrystalline silicon thin film transistors on the glass substrate 39, it is possible to provide flexibility to the substrate with respect to curvature by using a heat resistant plastic substrate etc. instead of the glass substrate 3

In addition, it is possible to use a p type polycrystalline silicon thin film transistor or an amorphous silicon thin film transistor which can be applied with low cost processing due to unnecessary crystallization instead of the n type polycrystalline silicon thin film transistor.

Furthermore, needless to say it is necessary to reverse the polarity of the voltages applied to the transistors when using p type thin transistors.

Alternatively, by using an amorphous oxide thin film transistor such as IInGaZnO instead of an n type polycrystalline silicon thin film transistor, it is possible to achieve low power consumption by reducing the amplitude of an image signal voltage and to reduce costs of processing apparatus compared to a polycrystalline silicon thin film transistor.

Fifth Embodiment

Figure 13:
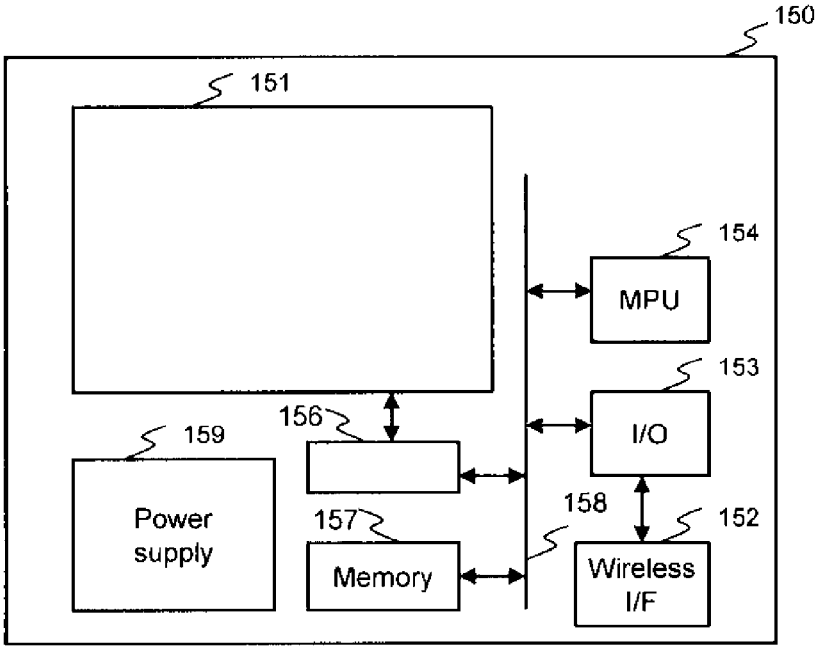
FIG. 13 is a block diagram which shows an approximate structure of an internet image display device which uses a mechanical shutter type image display device according to a fifth embodiment of the present invention.
Figure 14:
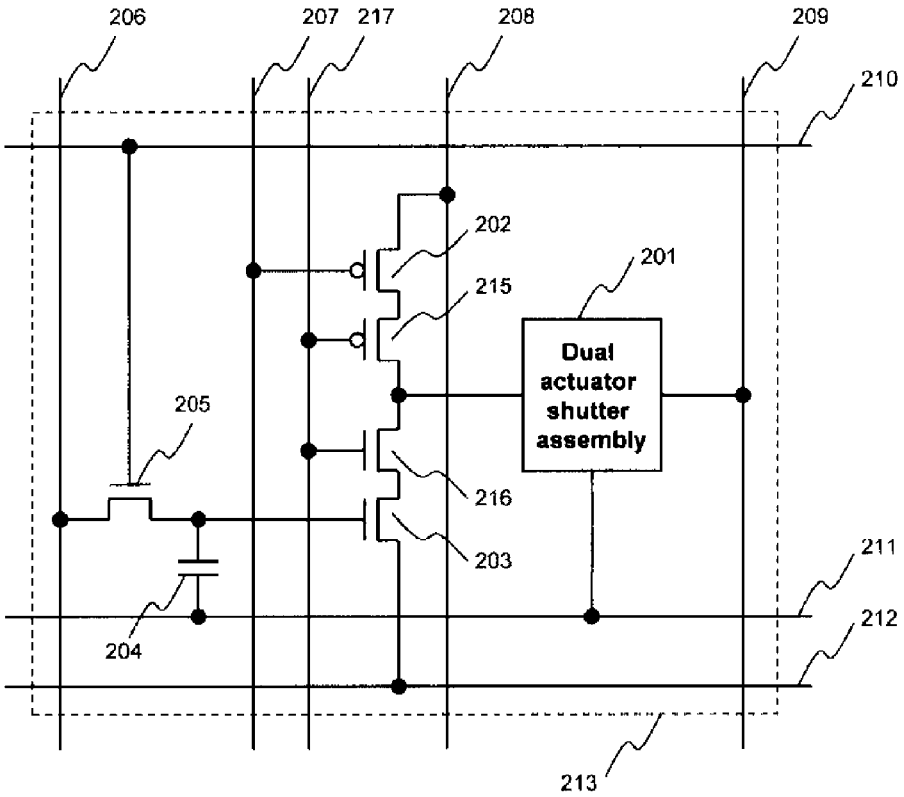
FIG. 14 is a circuit diagram which shows a pixel circuit of a conventional mechanical shutter type image display device.

FIG. 13 is a block diagram which shows an approximate structure of an internet image display device which uses a mechanical shutter type image display device according to a fifth embodiment of the present invention.

The fifth embodiment of the present invention is explained below with reference to FIG. 13.

Compressed image data etc. is externally input as wireless data to a wireless interface (I/F) circuit 152 and an output of the wireless interface circuit 152 is transferred to a data bus 158 via an I/O (Input/Output) circuit 153.

A microprocessor (MPU)) 154, display panel controller 156 and frame memory 157 etc. are also connected to the data bus 158.

In addition, the output of the display panel controller 156 is input to the display device 151 using a mechanical shutter. In addition, a power supply 159 is further arranged on an internet image display device 150.

Furthermore, here, because the display device 151 which uses a mechanical shutter has the same structure and operation as the first embodiment described above, descriptions related to this structure and operation are omitted.

The operation of the fifth embodiment is described below.

First, the wireless I/F circuit 152 receives the external compressed image data according to a command and sends this image data to the microprocessor 154 and frame memory 157 via the I/O circuit 153.

The microprocessor 154 receives a command operation from a user to execute decoding and processing of the compressed image data and displaying of information by driving entire image display device, as necessary. The processed image data can be temporarily stored in the frame memory 157.

Here, in the case where the microprocessor 154 outputs a display command, the image data is input to the display device 151 via the display panel controller 156 from the frame memory 157 according to the command and the display device 151 displays the input image data in real time.

At this time, the display panel controller 156 outputs predetermined timing pulse which is required for simultaneously displaying images.

Furthermore, the operation where the display device 151 uses these signals to display the input image data in real time is explained in the first embodiment. Furthermore, here, the power supply 159 includes a secondary battery which supplies a drive power to the entire internet image display device 150.

According to the present embodiment, high quality image display is possible and it is possible to provide the internet image display device 150 with low power consumption and at low cost.

Furthermore, in the present embodiment, the display device 151 explained in the first embodiment was used as an image display panel. It is clear that it is possible to use various display devices as described in the other embodiments as the image display panel.

However, in this case, it is necessary to make slight changes to a timing pulse output to the display panel controller 150 according to necessity.

As explained above, according to the present embodiment, it is possible to secure reliability of a pixel transistor without the need for a cascode transistor while maintaining high image quality which is the asset of a conventional mechanical shutter type image display device which uses a mechanical shutter such as high contrast and good color reproducibility while having low power consumption. Specifically, a transistor for programming a TFT electrode which applies a control voltage to a TFT electrode is not normally applied with a high voltage between a source and drain when a gate is turned ON. Consequently, it is possible to avoid reliability problems without the use of a cascode transistor etc.

In this way, according to the present embodiment, it is possible to achieve both high image quality and low power consumption in particular and both high definition and high reliability.

While the present invention performed by the inventors was explained in detail based on the embodiments described above, the present invention is not limited by the embodiments described above and various modifications can be made to the present invention within a scope that does not depart from the purport of the invention.

What is claimed is:

1. A display device electrically controlling a position of a mechanical shutter of each pixel to display an image, comprising:

a plurality of pixels each including the mechanical shutter;

a signal line inputting an image signal to each of the pixels;

a scanning line inputting a scanning voltage to each of the pixels; and an update line, wherein:

each of the pixels includes a pixel circuit electrically controlling a position of the mechanical shutter;

the pixel circuit includes a first control electrode, a second control electrode and a first control voltage application circuit, the mechanical shutter being put between the first and second control electrodes, said first control voltage application circuit inputting a first control voltage to the first control electrode according to the image signal;

the first control voltage application circuit includes an input transistor, a retaining capacitor and a first transistor, said input transistor having a first current terminal connected to the signal line, a gate connected to the scanning line, and a second current terminal; the retaining capacitor having a first terminal to be input with a capacitor control signal and a second terminal connected to the second current terminal of the input transistor; the retaining capacitor retaining a voltage input by the input transistor; and the first transistor having a gate connected to the second terminal of the retaining capacitor, a first current terminal connected to the first control electrode, and a second current terminal to be input with a first control signal;

a second control signal is input to the second control electrode;

a voltage level of the capacitor control signal, the first control signal, and the second control signal are changed at certain timing to control a position of the mechanical shutter;

the first control voltage application circuit further includes a sending transistor and a signal programming capacitor, the sending transistor having a gate connected to the update line between the second current terminal of the input transistor and the second terminal of the retaining capacitor, a first current terminal directly connected to the second current terminal of the input transistor, and a second current terminal directly connected to the second terminal of the retaining capacitor; and the signal programming capacitor includes a first terminal connected to the second current terminal of the input transistor and a second terminal.

2. The display device according to claim 1, further comprising:

a capacitor control line inputting the capacitor control signal to each of the pixels;

a first electrode line inputting the first control signal to each of the pixels;

a second electrode line inputting the second control signal to each of the pixels;

a shutter electrode line applying a certain voltage to the mechanical shutter;

a signal circuit supplying the image signal to the signal line;

a scanning circuit supplying a scanning voltage to the scanning line; and a control electrode drive circuit supplying the capacitor control signal, the first control signal, the second control signal and the certain voltage to the capacitor control line, the first electrode line, the second electrode line and the shutter electrode line, respectively.

3. The display device according to claim 1 further comprising:

a flat light source;

a transparent substrate; and a light blocking film arranged on the transparent substrate;

wherein the light blocking film includes an optical aperture corresponding to each pixel and blocks light emitted from the flat light source at regions other than the optical aperture.

4. The display device according to claim 1, wherein a pair of the signal lines are arranged in parallel, and a gate of an input transistor of two pixels adjacent to each other in an extended direction of the signal lines are commonly connected and one of the current terminals of the input transistors of the two pixels are connected to the signal lines arranged in pairs in parallel, respectively.

5. The display device according to claim 1, wherein the sending transistor is turned ON before the capacitor control signal is input to the first terminal of the retaining capacitor and the second control signal is input to the second current terminal of the first transistor in each pixel.

6. A driving method of a display device electrically controlling a position of a mechanical shutter to display an image, wherein the display device includes:

a plurality of pixels each including the mechanical shutter;

a signal line inputting an image signal to each of the pixels;

a scanning line inputting a scanning voltage to each of the pixels; and an update line, wherein:

each of the pixels includes a pixel circuit electrically controlling a position of the mechanical shutter;

the pixel circuit includes a first control electrode, a second control electrode and a first control voltage application circuit, the mechanical shutter being put between the first and second control electrodes, said first control voltage application circuit inputting a first control voltage to the first control electrode according to the image signal;

the first control voltage application circuit includes an input transistor, a retaining capacitor and a first transistor, said input transistor having a first current terminal connected to the signal line, a gate connected to the scanning line, and a second current terminal; the retaining capacitor having a first terminal to be input with a capacitor control signal and a second terminal connected to the second current terminal of the input transistor; the retaining capacitor retaining a voltage input by the input transistor; and the first transistor having a gate connected to the second terminal of the retaining capacitor, a first current terminal connected to the first control electrode, and a second current terminal to be input with a first control signal;

a second control signal is input to the second control electrode;

a voltage level of the capacitor control signal, the first control signal, and the second control signal are changed at certain timing to control a position of the mechanical shutter;

the first control voltage application circuit further includes a sending transistor and a signal programming capacitor, the sending transistor having a gate connected to the update line between the second current terminal of the input transistor and the second terminal of the retaining capacitor, a first current terminal directly connected to the second current terminal of the input transistor, and a second current terminal directly connected to the second terminal of the retaining capacitor, the signal programming capacitor having a first terminal connected to the second current terminal of the input transistor; whereby the sending transistor is turned ON before time a time, t1, to send the voltages retained in the signal programming capacitor to the retaining capacitor in one batch;

said method comprising:

applying a voltage of a second voltage level to the mechanical shutter during one sub-frame time period, wherein the sub-frame time period includes a sequence of time instants from the time t1 to a time t6;

changing a voltage of the second control signal from a first voltage level to the second voltage level at time t1 after a voltage corresponding to the image signal is retained in the retaining capacitor of all the pixels, and from the second voltage level to the first voltage level at time t6, whereby the voltage of the second control electrode is changed to the second voltage level at time t1 and to the first voltage level at time t6;

changing a voltage of the capacitor control signal from the first voltage level to the second voltage level at time t2 and from the second voltage level to the first voltage level at time t4; and changing the first control voltage from an intermediate voltage level to the second voltage level at time t3, from the second voltage level to the first voltage level at time t4 and from the first voltage level to the intermediate voltage level at time t5.

7. The driving method of a display device according to claim 6, wherein a voltage of the first voltage level is applied to the mechanical shutter instead of applying a voltage of the second voltage level to the mechanical shutter within the sub-frame time period, and a voltage of the second control signal is changed to the first voltage level from the second voltage level at time t1, and the voltage of the second control signal is changed to the second voltage level from the first voltage level at time t6, whereby the voltage of the second control electrode becomes the first voltage level at time t1 and becomes the second voltage level at time t6.

* * * * *